US006779793B2

(12) United States Patent
Behrens et al.

(10) Patent No.: US 6,779,793 B2
(45) Date of Patent: Aug. 24, 2004

(54) DEVICE FOR DECOLLATING FLAT OBJECTS, PREFERABLY PRINTING PLATES

(75) Inventors: Gunnar Behrens, Kiel (DE); Axel Trilk, Kiel (DE); René Retzlaff, Westerrönfeld (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/195,750

(22) Filed: Jul. 15, 2002

(65) Prior Publication Data

US 2003/0011123 A1 Jan. 16, 2003

(30) Foreign Application Priority Data

Jul. 13, 2001 (DE) ..... 101 34 151

(51) Int. Cl.[7] ..... B65H 3/12

(52) U.S. Cl. ..... 271/283; 271/103; 271/104; 271/106

(58) Field of Search ..... 271/104, 106, 271/107, 95, 103, 105, 283, 284

(56) References Cited

U.S. PATENT DOCUMENTS

| | | | | | |
|---|---|---|---|---|---|
| 2,060,800 | A | * | 11/1936 | Ehrig et al. | 271/107 |
| 2,995,360 | A | * | 8/1961 | Simpson | 271/107 |
| 3,947,020 | A | * | 3/1976 | Kobayashi | 271/283 |
| 4,382,593 | A | * | 5/1983 | Beran et al. | 271/12 |
| 4,402,592 | A | * | 9/1983 | Schon et al. | 399/166 |
| 4,462,678 | A | * | 7/1984 | Back | 399/166 |
| 4,637,600 | A | * | 1/1987 | Bartimes et al. | 271/93 |
| 4,667,948 | A | | 5/1987 | Angelbeck et al. | |
| 4,735,407 | A | * | 4/1988 | Ozawa | 271/3.12 |
| 5,163,673 | A | | 11/1992 | Heppenstiel | |
| 5,367,360 | A | * | 11/1994 | McIlwraith et al. | 355/85 |
| 5,553,841 | A | * | 9/1996 | Greive | 271/104 |
| 5,727,466 | A | | 3/1998 | Greive et al. | |
| 5,785,309 | A | * | 7/1998 | Halup et al. | 271/11 |
| 6,422,801 | B1 | * | 7/2002 | Solomon | 414/416.07 |
| 6,425,578 | B1 | * | 7/2002 | Wood et al. | 271/37 |

FOREIGN PATENT DOCUMENTS

| | | |
|---|---|---|
| DE | 41 12 379 A1 | 10/1992 |
| DE | 44 02 885 C2 | 8/1995 |
| EP | 0 080 798 B1 | 6/1983 |
| EP | 1 055 621 A2 | 11/2000 |
| JP | 01 261 136 A | 10/1989 |
| JP | 02 117 532 A | 5/1990 |
| JP | 06 179 256 A | 6/1994 |
| JP | 2002 053 235 A | 2/2002 |

* cited by examiner

*Primary Examiner*—Patrick Mackey
(74) *Attorney, Agent, or Firm*—Laurence A. Greenberg; Werner H. Stemer; Ralph E. Locher

(57) ABSTRACT

The invention relates to a device for decollating flat objects from a stack, in particular objects individually separated from one another in the stack by interlayers, preferably printing plates. The object of the invention is to ensure that only one object is taken from the stack and made available for any further handling. A lifting device lifts the object from the stack and a separating device separates any article possibly adhering to the underside of the lifted object from the lifted object. The article possibly adhering may in particular be a second object or an interlayer. For example, the separating device may be of similar construction to the lifting device and in particular include suction elements.

18 Claims, 6 Drawing Sheets

DEVICE FOR DECOLLATING FLAT OBJECTS, PREFERABLY PRINTING PLATES

BACKGROUND OF THE INVENTION

Field of the Invention

The invention relates to a device for decollating flat objects from a stack, in particular objects individually separated from one another in the stack by interlayers, preferably printing plates.

For individually handling flat objects that are stacked on top of one another, the objects first must be decollated and then fed individually one after the other into a processing machine. In particular, printing plates must be introduced individually into a printing plate exposure machine for purposes of exposure. While decollating may be done manually, an automatic loading device (loader) is preferred. Such a device can be connected or docked before a printing plate exposure machine. A stack of printing plates to be exposed is fed into the loading device and the loading device should have available to it a decollating device of the generic category identified at the outset in order to allow automatic decollation and loading.

However, the decollation operation and the loading operation can be disturbed and adversely affect or impede the subsequent machining whenever a plurality of objects adhere to one another or an object adheres to an interlayer. Interlayers are used to separate an object from a succeeding or preceding object in the stack. In the case of printing plates, sheets of paper can be used as interlayers for purposes of separation. It is also possible that such interlayers have not been provided, in individual cases, are inadvertently missing, or are present in a double layer.

SUMMARY OF THE INVENTION

It is accordingly an object of the invention to provide a device for decollating flat objects, preferably printing plates, that overcomes the hereinafore-mentioned disadvantages of the heretofore-known devices of this general type and that ensures that one object and one object alone is taken from the stack and made available for any further handling.

With the objects of the invention in view, there is also provided a device including a lifting device and a separating device. The lifting device is for lifting one of the objects from the stack. The separating device is for separating an article possibly adhered to the underside of the lifted object from the lifted object.

This task is solved according to the invention by a lifting device for lifting the object from the stack and a separating device for separating any article possibly adhering to the underside of the lifted object from the lifted object. Typically, the article that is adhering is a second object or an interlayer.

In the problem area of malfunctions in object decollation indicated merely in outline above, a number of cases may be distinguished all of which must be reliably overcome by the device according to the invention.

First, there may be the desired situation in which from the outset only one object is seized and removed from the stack. No special measures need be provided for this regular case. According to the invention, the object is lifted by the lifting device and made available on its own.

In an undesired situation, a second object might adhere to the underside of the upper object in the stack. The upper object might then be lifted together with the second object adhering thereto. However, this problem could be solved by the lifting action itself in that the force of gravity acts on the lower object and the latter falls by itself back onto the stack, especially according to a refinement of the invention when a suction element lifts the object by acting only from above on the upper object. Otherwise, if necessary, the lower object may be actively separated off using the separating device provided according to the invention.

In another case, an interlayer may adhere to the underside of the lifted object. This too could fall back again by itself onto the stack due to the force of gravity or if it is separated from the object before the object is made available by the separating device according to the invention.

As for the rest, it may be regarded as regular and specified for the device according to the invention that an object and an interlayer each alternate in the stack. Therefore, on each second lifting action of the lifting device, an object is lifted. Therebetween, in each case, in each second lifting action of the lifting device, an intermediate stacking unit is lifted. In the second lifting action, an object may be made available in each case for further handling. Each intermediate stacking unit, in each case, may be transported away for disposal or recycling. Thus, for this purpose, the device according to the invention could operate at twice as high a working rhythm as a following processing machine. Moreover, the same lifting device could be used for the objects and the interlayers.

According to the invention, the lifting device preferably seizes the object to be lifted only in the region of an edge. This protects the object as much as possible. In this manner, in the case of a printing plate for example, the area to be imprinted is not adversely affected. Rather, the printing plate is seized, for example, only in the peripheral region, which in any case is provided only for stamping.

The separating device according to the invention can be constructed as a type of peeling element, similar to a doctor knife for example, wherein such a separating element can be disposed in stationary manner, for example as an edge of a support table. Then, the lifted object is conveyed over the edge so that any interlayer possibly attached on the underside is held back and peeled off. As a result, the object is freed of this interlayer, which can fall into a disposal container.

Alternatively, the separating device may also be of more active construction. In another alternative, a plurality of different separating devices may also be provided.

The single separating device can by way of example be of similar construction to the lifting device and in particular include suction elements. The lifting device can then grip the object on the upper side and in similar fashion the separating device can seize any interlayer or second object adhering on the underside and the lifting device and the separating device then pull the object and the interlayer or the second object apart to separate them. If the object and the interlayer are generally regarded as an article, a guide system for the orderly pick-up and transport away of an article can be provided according to a development of the invention.

Preferably, the separating device possesses a carrier element that also serves as a movable transport support for the object. Thus, the carrier element can transport an object onwards just while an interlayer can be transported away for disposal.

Advantageously, the transport support can be of flexible construction, preferably shaped like a shutter. The transport path for an object can then extend in a level manner on an upper plane and the peeling element can project into the region of transfer of the object from the transport support to a support table. In contrast, an interlayer is transported downwards ahead of or upon reaching the peeling element by turning of the transport support so that there is a sort of switch point for objects and interlayers in the region of the peeling element.

The transport support can be part of a transport element that extends in a closed loop over diversion members. In the transport element, articles to be disposed, in particular interlayers, are carried into the region of the lower strand of the loop. There, the articles to be disposed are allowed to fall into a container. In doing so, the articles may advantageously be deposited in orderly manner so that instead of disposal, selective recycling is also possible.

Preferably, the device according to the invention includes sensor devices for monitoring and controlling the operating sequence. In particular, the sensor devices are used for deciding which alternative possible operating sequence is appropriate in a situation found by a sensor device. Thus, a first sensor recognizes whether an article is adhering to the underside of an object lifted from the stack. In doing so, the sensor also can recognize whether the adhering article is another object or an interlayer. The sensor's recognition can be based on differing light reflection properties of these possible articles. Thus, the sensors distinguish between the cases referred to above: that is, whether an already decollated object is being made available, whether an interlayer has been lifted in an intermediate work cycle and has to be disposed, whether an interlayer is adhering to the underside of a lifted object and must first be separated off and then disposed, or whether adhering to the object is a second object which should be separated off and fall back onto the stack.

Preferably, the device according to the invention further includes a second sensor that recognizes the supply of a decollated object and thereby initiates a further handling operation. An example of a further handling operation is the introduction of a printing plate to be exposed into an exposure machine. This second sensor may be disposed in the region of a peeling element, preferably a little behind the peeling element in the direction of transport of the object.

Additionally, in a further development of the device includes a clasp element. The clasp element acts in conjunction with the lifting device and by way of example supports an object lifted at the edge by its upper side at the edge on its underside.

Other features that are considered as characteristic for the invention are set forth in the appended claims.

Although the invention is illustrated and described herein as embodied in a device for decollating flat objects, preferably printing plates, it is nevertheless not intended to be limited to the details shown, because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
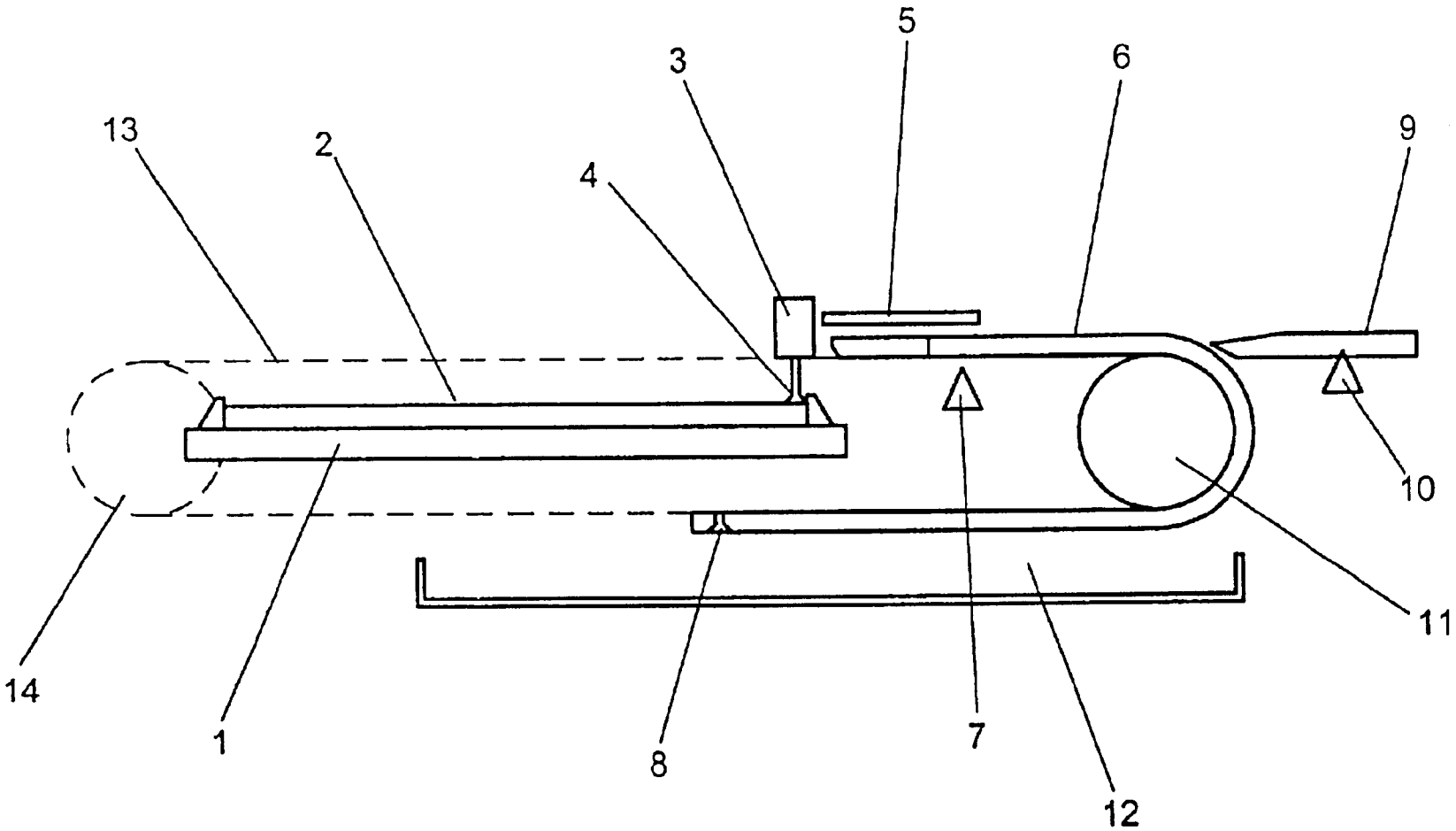
FIG. 1 is a diagrammatic side partial sectional view of a device for decollating flat objects according to the invention.

In all the figures of the drawing, sub-features and integral parts that correspond to one another bear the same reference symbol in each case.

Referring now to the figures of the drawings in detail and first, particularly to FIG. 1 thereof, there is shown schematically and only in principle a side sectional view of an exemplified embodiment of a device according to the invention. This shows in outline a device that decollates printing plates from a stack of plates. The object of the invention is to provide a device handling printing plates having the most diverse formats, thicknesses, and coatings. A further object is to stack plates and separate them individually from one another with interlayers of protective paper. A further object is to decollate gently, rapidly, and reliably.

The embodiment illustrated in FIG. 1 includes a type of plate holder 1 in which a stack of plates 2 is disposed. From this stack of plates 2, the upper printing plate at any time is to be removed individually and supplied by further transport, preferably for introduction into an exposure machine. The interlayer appearing under each removed printing plate is likewise to be removed from the stack of plates 2 and deposited in orderly manner for disposal or reuse.

For lifting a printing plate or an interlayer at the edge by its upper side from a stack of plates 2, a substantially strip-shaped lifting device 3 having suction elements 4 is provided. To support the lifted edge of the article lifted by the suction elements 4, a clasp member 5 can act intermittently and grip under the article. Together with the lifting device 3, the clasp member 5 can clasp the article.

Serving as transport support for the lifted article is a shutter 6. The shutter 6 can be moved under the article. The lifting device 3 can set the article onto the shutter 6 after the article has been released by the clasp member 5. Disposed beneath the clasp member 5 is a sensor 7. The sensor 7 can recognize what type of article, printing plate, or interlayer, has been lifted and whether another article is adhering to the underside of this article. For this purpose, the sensor 7 may be constructed as a color sensor, ultrasonic sensor, or light reflection sensor.

The shutter 6 possesses its own suction elements 8 that fix to the underside of the deposited article. The article may be a printing plate, an interlayer, or an interlayer adhered to the underside of the deposited printing plate. The previously mentioned sensor 7 determines the type of article fixed by the suction elements 8. Depending on whether a printing plate or an interlayer is fixed by the suction elements 8, the suction elements 8 are switched off eventually during transport of the deposited article.

A printing plate set down on the shutter 6 is slid over a doctor knife 9 after the suction elements 8 have released it onto a delivery table. The delivery table is not shown in more detail and adjoins the doctor knife on the same plane. A second sensor 10 recognizes the arrival of a printing plate in the appropriate supply position. The second sensor 10 is disposed in the region of the doctor knife 9.

On the other hand, an interlayer is carried along in the diversion of the shutter 6 around a diverting roller 11 while the suction elements 8 continue in operation and is deposited only into a paper depository 12.

The shutter 6 is a component of a circulating transport element 13 that circulates in a closed loop via diverting rollers 11 and 14. In doing so, the shutter 6 can be moved in two directions: by counter-clockwise circulation of the transport element 13 into a receiving position for a lifted article and by clockwise circulation of the transport element 13 for transport and for delivery of a deposited printing plate via the doctor knife 9 and/or for carrying along a sucked-on interlayer towards the paper depository 12.

Figure 2A:
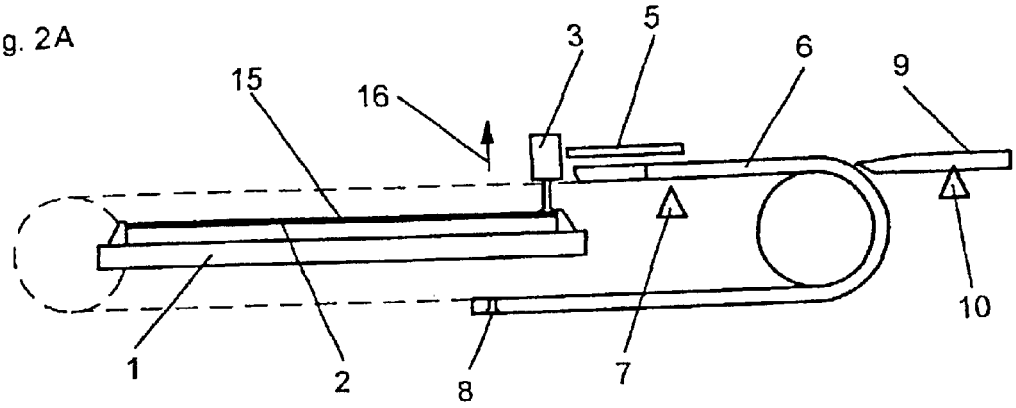
FIGS. 2A to 2H are side partial sectional views of the device in FIG. 1 during decollation of a printing plate.
Figure 2B:
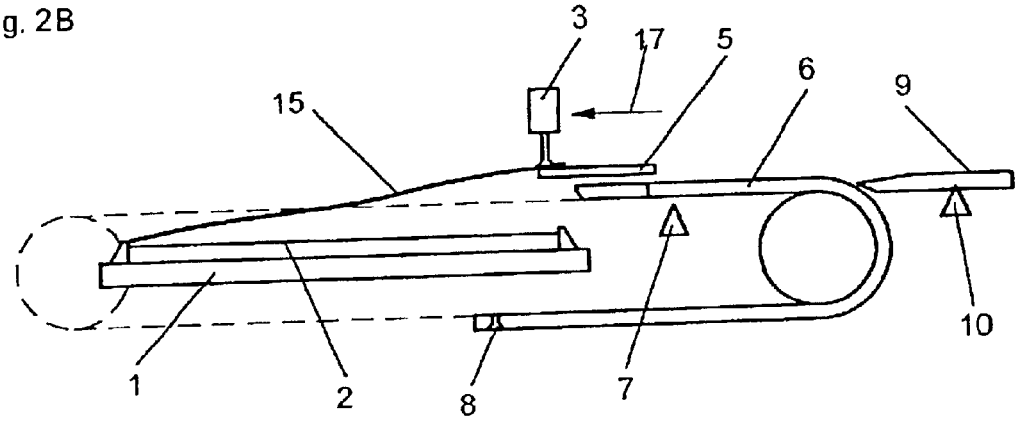
Figure 2C:
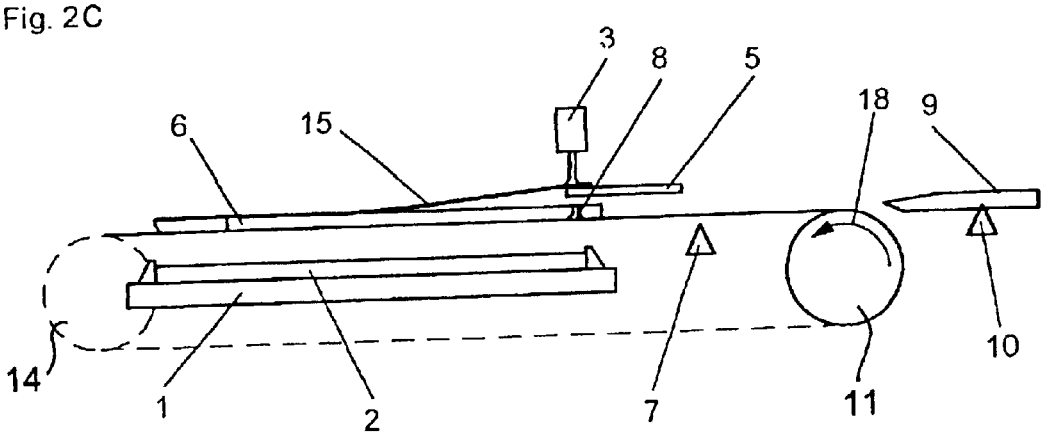
Figure 2D:
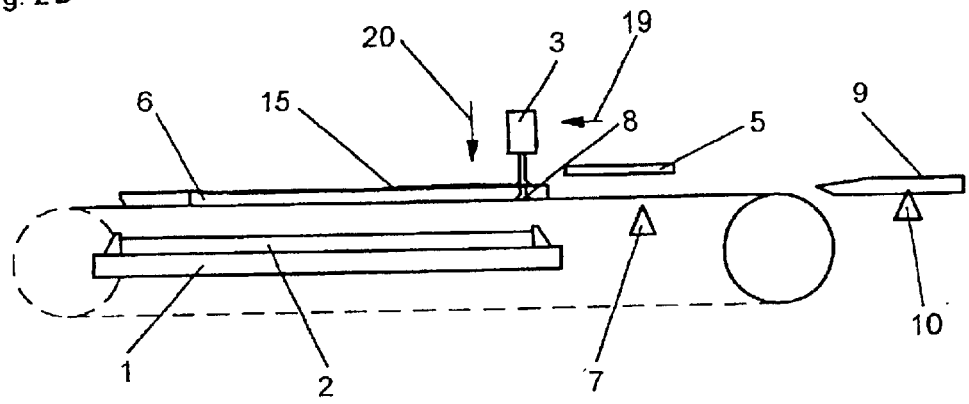
Figure 2E:
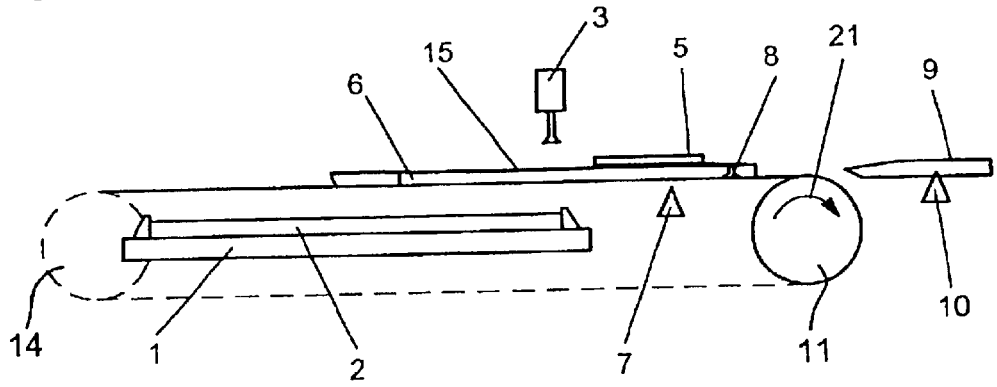
Figure 2F:
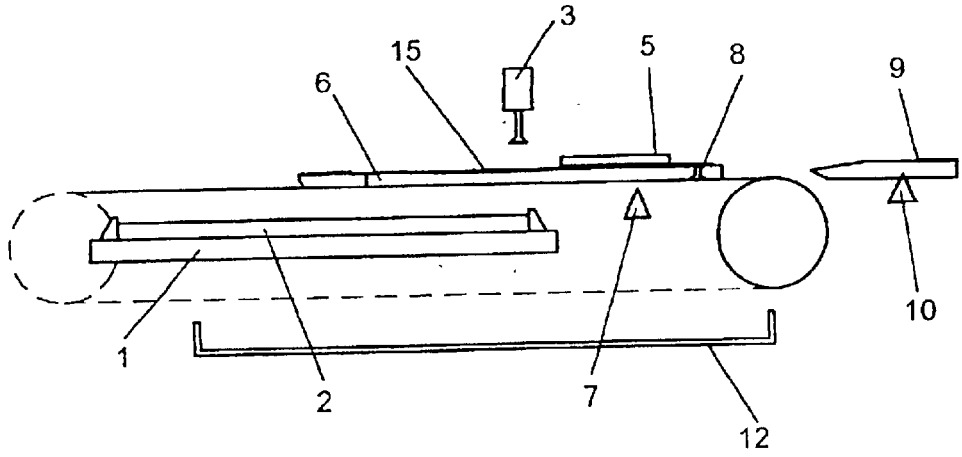
Figure 2G:
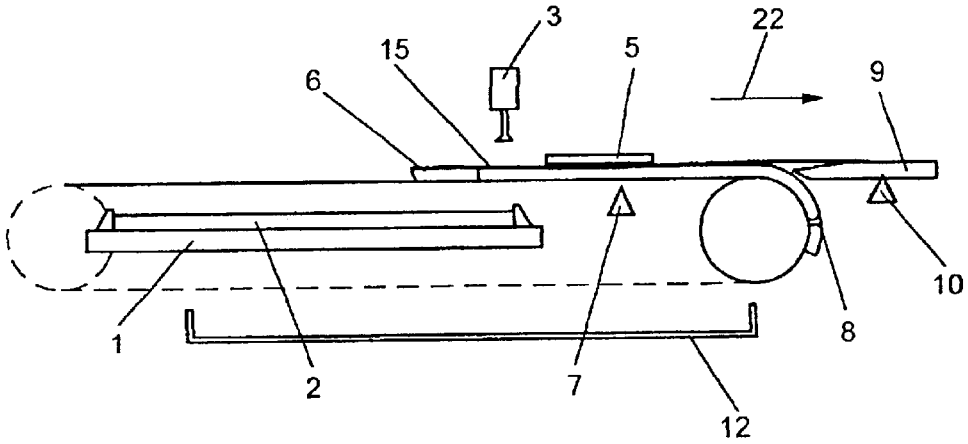
Figure 2H:
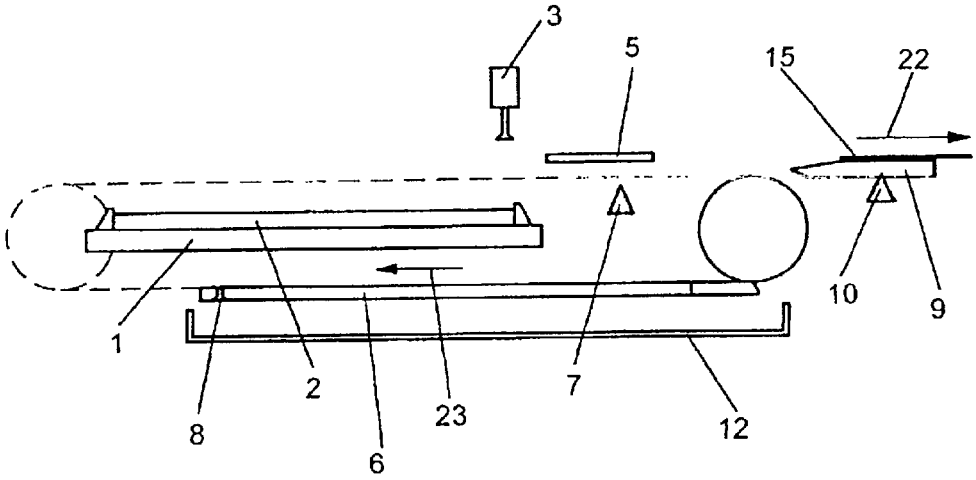
Figure 3A:
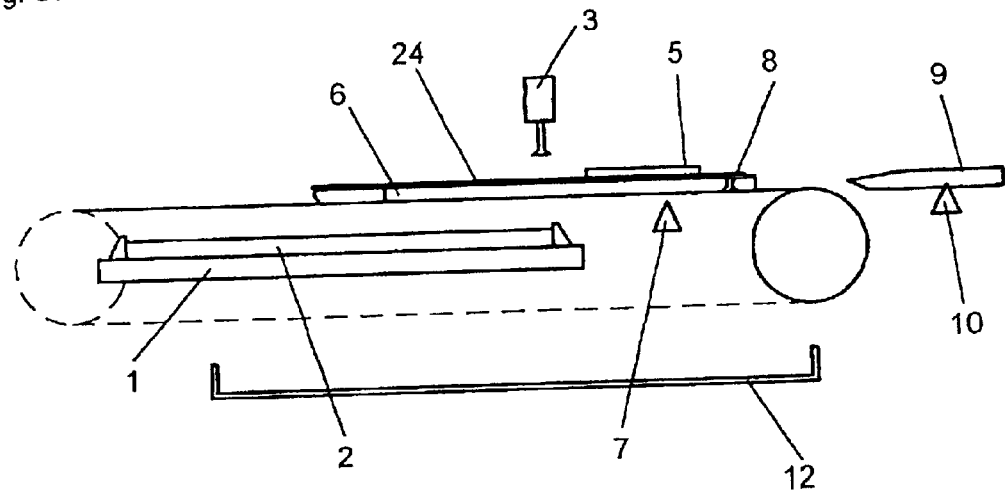
FIGS. 3A to 3C are side partial sectional views of the device in FIG. 1 during removal and depositing of an interlayer.

FIGS. 2 to 4 with their part figures show sequences of motion and operation of the device according to FIG. 1 in cases to be distinguished.

In FIGS. 2A to 2H, the device of FIG. 1 is illustrated in different operating phases, to be more precise in the course of decollating only one printing plate 15.

In FIG. 2A, the suction elements of the lifting device 3 act and seize the edge of the printing plate 15 on the upper side and lift the latter in the direction of the arrow 16.

In FIG. 2B, the clasp member 5 travels in the direction of the arrow 17 under the lifted edge of the printing plate 15 and clasps and supports it.

In FIG. 2C, the diverting rollers 11, 14 of the transport element rotate counter-clockwise in the direction of the arrow 18 and as a result move the shutter 6 as transport support under the printing plate 15. As a result, the printing plate 14 rises further as a whole. Another printing plate or an interlayer that might be adhering under the lifted printing plate 15 and would hang down a little from the latter would be separated from the printing plate 15 by the interposition of the shutter 6. In this manner, the shutter 6 could additionally function as a separating device.

In FIG. 2D, the lifting device 3 lowers the printing plate 15 onto the shutter 6 in the direction of the arrow 20. At the same time, the clasp member 5 releases the printing plate 15 by moving in the direction of the arrow 19. The suction elements 8 of the shutter 6 activate to suck the printing plate 15 in the direction of the arrow 20 and fix it on the shutter 6.

In FIG. 2E, the diverting members 11, 14 move clockwise in the direction of the arrow 21 so that the shutter 6 moves carrying the printing plate 15 with it towards the doctor knife 9.

At the latest in FIG. 2F, the sensor 7 checks whether there is still an interlayer adhering under the printing plate 15. If not, as illustrated, the suction elements 8 of the shutter 6 release the underside of the printing plate 15 so that the printing plate 15 can be exchanged from the shutter 6 onto the doctor knife 9. In the event that there should be an interlayer adhering to the underside of the printing plate 15 after all, the suction elements 8 of the shutter 6 continue in operation and carry this interlayer along on the further path of the shutter 6. Handover of the printing plate 15 is nevertheless possible because the suction elements 8 of the shutter 6 act only on the interlayer and the printing plate 15 itself is not fixed.

In FIG. 2G, the depicted transfer of the printing plate 15 from the shutter 6 onto the doctor knife 9 and further movement in the direction of the arrow 22 takes place. The sensor 10 registers the arrival of a printing plate in the region of the doctor knife 9 and reports, for example to an exposure machine following in the direction of the arrow 22, the supply of a printing plate 15.

In FIG. 2H, the printing plate 15 is transported onwards in the direction of the arrow 22 by the shutter 6 continuing to move in the direction of the arrow 23. After the doctor knife 9, a succeeding transport device that is not illustrated takes the printing plate 15.

Figure 3B:
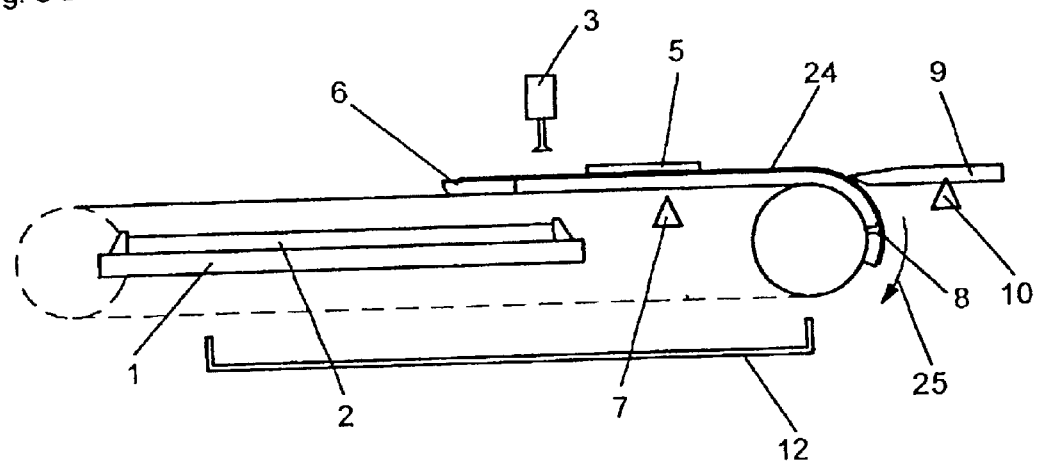
Figure 3C:
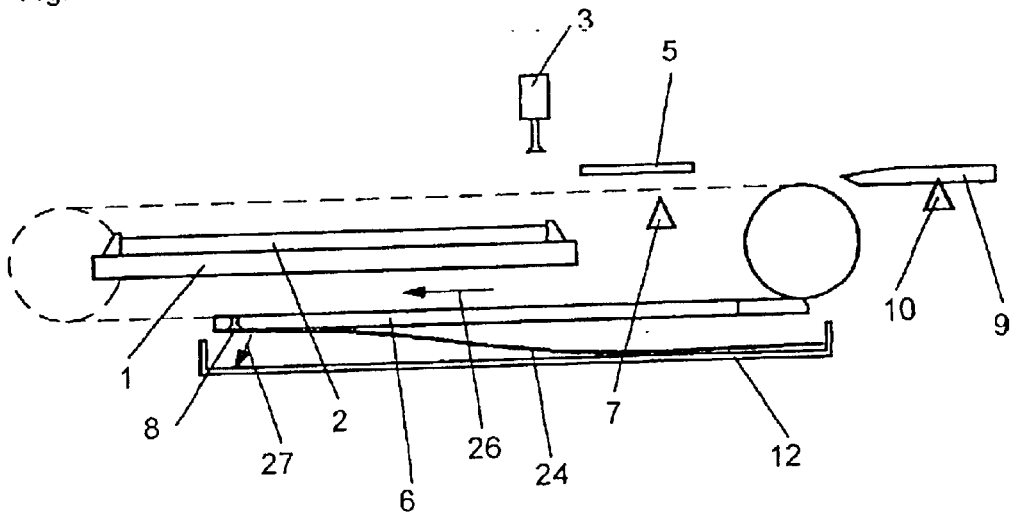

FIGS. 3H to *c* depict a situation in which the device has picked up a single interlayer 24 instead of a printing plate 15. In this case, the operating positions of the device in FIGS. 3H to *c* correspond approximately to the positions shown in FIGS. 2F to *h*.

In FIG. 3H, the presence of an interlayer 24 on the shutter 6 is recognized by the sensor 7. Accordingly, the suction elements 8 of the shutter 6 remain in operation.

In FIG. 3B, the interlayer 24 is diverted by the suction elements 8 with the shutter 6 in the direction of the arrow 25 and carried along past the doctor knife 9.

In FIG. 3C, the interlayer 24 is then released by the suction elements 8 and deposited in the paper depository 12 in the direction of the arrow 27 after the shutter 6 has moved in the direction of the arrow 26 to a point above the paper depository 12.

Figure 4A:
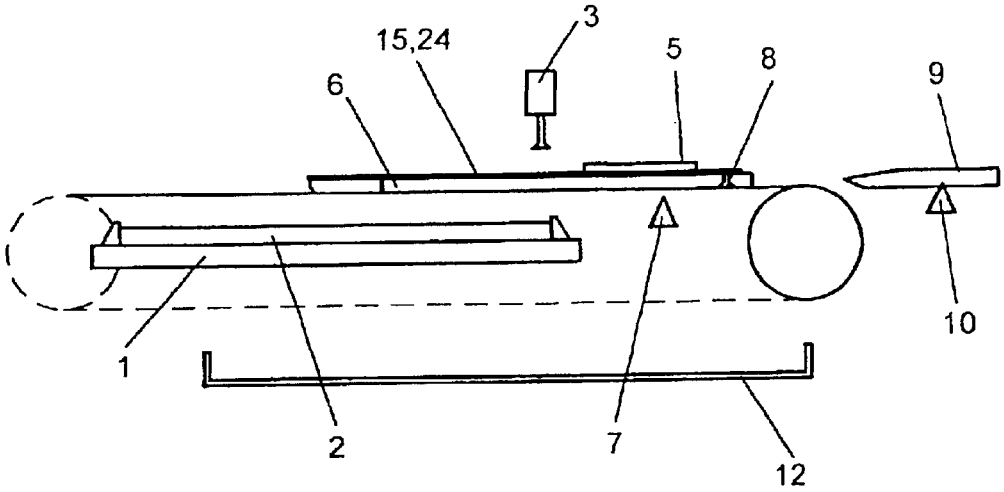
FIGS. 4A to 4C are side partial sectional views of the device in FIG. 1 during separation of a printing plate and an interlayer.
Figure 4B:
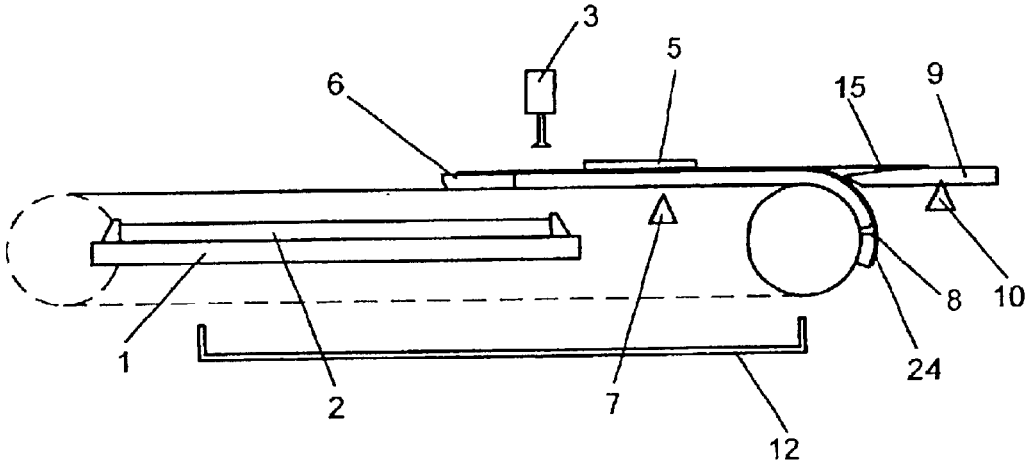
Figure 4C:
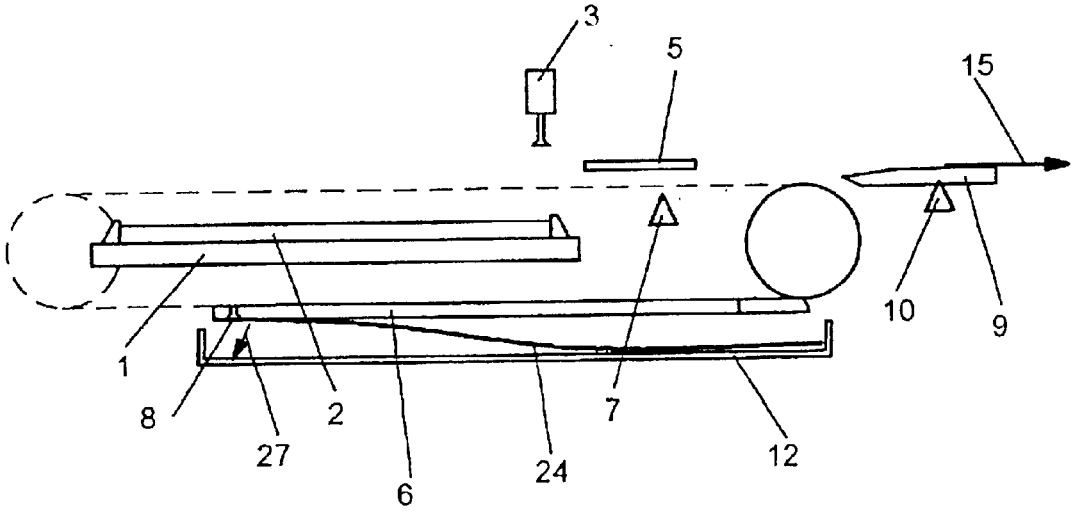

In FIGS. 4A to 4C, the lifting device 3 has picked up a printing plate 15 together with an interlayer 24 still adhered to the underside thereof. The positions of the device in FIGS. 4A to 4C correspond to the positions in FIGS. 3H to 3C.

In FIG. 4A, the sensor 7 recognizes that an interlayer 24 is present on the shutter 6. Accordingly, it does not shut off the suction elements 8 in the shutter 6.

In FIG. 4B, the interlayer 24 and the printing plate 15 are separated from one another because, due to the movement of the shutter 6, the printing plate 15 that is not fixed is pushed over the doctor knife 9 while the interlayer 24 is carried by the suction elements 8, diverted in accordance with the turning of the shutter 6, and forced downwards. The sensor 10 recognizes in quite normal manner the arrival of the printing plate 15 in the region of the doctor knife and reports that the printing plate 15 has been delivered.

In FIG. 4C, the printing plate 15 is transported beyond the doctor knife 9 while the interlayer 24 is released by the suction elements 8 and deposited in the paper depository 12 in the direction of the arrow 27.

We claim:

1. A device for decollating a stack of flat objects, each of the objects having an underside, comprising:

a lifting device for lifting one of the flat objects from the stack;

a separating device for separating an article adhering to the underside of a lifted object from the lifted object and including a carrier element for seizing and carrying the article adhering to the underside of the lifted object; and a transport support being movable under the lifted object, said transport support including said carrier element as a component.

2. The device according to claim 1, wherein said lifting device includes a suction element for auctioning to the flat objects.

3. The device according to claim 1, wherein said lifting device seizes an object to be lifted only at an edge thereof.

4. The device according to claim 1, wherein said separating device includes a peeling element.

5. The device according to claim 4, wherein said peeling element is a doctor knife.

6. The device according to claim 4, wherein an object being lifted is movable by its underside over said peeling element.

7. The device according to claim 1, wherein said carrier element is a suction element assigned to the underside of the lifted object.

8. The device according to claim 1, including a guide system for transporting the article.

9. The device according to claim 1, wherein said transport support is flexible, follows a transport path of the object, and can be turned away from the underside of the object.

10. The device according to claim 9, wherein said separating device includes a peeling element disposed along said transport path where said transport support can be turned away.

11. The device according to claim 9, further comprising a diverting member guiding said transport support, said transport support being shaped like a shutter.

12. The device according to claim 11, further comprising:

diverting rollers; and a transport element wrapped around said diverting rollers, said transport element including said transport support.

13. The device according to claim 1, further comprising a depository for receiving articles, said carrier element carrying the article to said depository.

14. The device according to claim 12, further comprising a depository for receiving articles positioned underneath said transport element, said carrier element carrying the article to said depository.

15. A device for decollating a stack of flat objects, each of the objects having an underside, comprising:

a lifting device for lifting one of the flat objects from the stack;

a separating device for separating an article adhering to the underside of a lifted object from the lifted object and including a carrier element for seizing and carrying an article adhering to the underside of the lifted object and a peeling element disposed along said transport path where said transport support can be turned away;

a flexible transport support being movable under the lifted object, following a transport path of the object, can be turned away from the underside of the object, and including said carrier element as a component; and a recognition device for determining when an article is adhering to the underside of the lifted object.

16. The device according to claim 15, including a further recognition device for determining when an object has been removed from the stack and reaches a delivery position.

17. The device according to claim 16, wherein said second recognition device is disposed by said peeling element.

18. The device according claim 1, including a clasp element acting in conjunction with said lifting device.

* * * * *